US010358782B2

(12) United States Patent
Holman

(10) Patent No.: US 10,358,782 B2
(45) Date of Patent: Jul. 23, 2019

(54) PLOW ASSEMBLY WITH WINGS

(71) Applicant: STONEBROOKE EQUIPMENT INC., Burnsville, MN (US)

(72) Inventor: Jerry D. Holman, Lakeville, MN (US)

(73) Assignee: STONEBROOKE EQUIPMENT, INC., Burnsville, MN (US)

( * ) Notice: Subject to any disclaimer, the term of this patent is extended or adjusted under 35 U.S.C. 154(b) by 4 days.

(21) Appl. No.: 15/629,809

(22) Filed: Jun. 22, 2017

(65) Prior Publication Data

US 2017/0370060 A1 Dec. 28, 2017

Related U.S. Application Data

(60) Provisional application No. 62/355,461, filed on Jun. 28, 2016.

(51) Int. Cl.
*E01H 5/06* (2006.01)

(52) U.S. Cl.
CPC ..... *E01H 5/067* (2013.01); *E01H 5/061* (2013.01)

(58) Field of Classification Search
CPC ..... E01H 5/067; E01H 5/061; E01H 5/065; E01H 5/066; E01H 5/06; E01H 5/062–064
See application file for complete search history.

(56) References Cited

U.S. PATENT DOCUMENTS 1,383,409 A 7/1921 Liddell
2,841,897 A * 7/1958 Duke ..... E02F 3/815 172/701.1
3,208,166 A * 9/1965 Proulx ..... E01H 5/066 172/133
3,231,991 A * 2/1966 Wandscheer ..... E01H 5/063 172/782
3,477,151 A 11/1969 Zanella
4,145,825 A 3/1979 Bertolino
4,669,205 A 6/1987 Smathers
5,129,169 A 7/1992 Aubichon
5,285,588 A * 2/1994 Niemela ..... E01H 5/065 37/232

(Continued)

FOREIGN PATENT DOCUMENTS

DE 1299675 7/1969

*Primary Examiner* — Robert E Pezzuto
*Assistant Examiner* — Joan D Misa
(74) *Attorney, Agent, or Firm* — Honigman LLP

(57) ABSTRACT

A plow assembly includes a mounting structure configured to mount at a vehicle, a center plow attached at the mounting structure, and a plow wing mounted at an end of the center plow via a first attachment assembly and a second attachment assembly. Each of the first and second attachment assemblies includes an elongated attachment element and a biasing element. The elongated attachment element attaches a respective rear portion of the plow wing at the center plow and engages the biasing element at the rear of the center plow. The biasing element allows for movement of the attachment element at the rear of the center plow to allow for pivotal movement of the plow wing relative to the center plow. The biasing element limits pivotal movement of the plow wing and biases the plow wing towards a neutral state, where the plow wing is generally normal to the center plow.

20 Claims, 16 Drawing Sheets

(56) References Cited

U.S. PATENT DOCUMENTS 5,375,349 A * 12/1994 Jochim ..... E01H 5/065 37/281
5,860,230 A * 1/1999 Daniels ..... E01H 5/06 172/816
5,899,007 A 5/1999 Niemela et al.
6,178,669 B1 1/2001 Quenzi et al.
6,240,660 B1 * 6/2001 Dugas ..... E01H 5/066 37/280
6,393,737 B2 5/2002 Quenzi et al.
6,408,549 B1 6/2002 Quenzi et al.
6,412,199 B1 7/2002 Quenzi et al.
6,442,877 B1 9/2002 Quenzi et al.
6,594,924 B2 7/2003 Curtis
6,823,615 B2 11/2004 Strait
6,928,757 B2 8/2005 Bloxdorf et al.
7,107,709 B2 9/2006 Hamel
7,134,227 B2 11/2006 Quenzi et al.
7,360,327 B2 4/2008 Osgood et al.
7,555,853 B2 7/2009 Paonessa
7,654,016 B2 2/2010 Stephan
7,658,022 B2 * 2/2010 Strait ..... E01H 5/063 37/232
7,779,563 B2 * 8/2010 Mills ..... E01H 5/066 37/232
7,941,947 B2 5/2011 Stephan
7,975,409 B2 7/2011 Paonessa
8,607,482 B2 * 12/2013 Bloxdorf ..... E01H 5/065 37/274
8,776,405 B2 7/2014 Paonessa
8,850,724 B2 * 10/2014 Bloxdorf ..... E01H 5/067 172/815
8,887,413 B2 11/2014 Miller
9,243,376 B2 * 1/2016 Guggino ..... E01H 5/066
9,255,370 B2 2/2016 Paonessa
2013/0025629 A1 1/2013 Vigneault
2016/0040379 A1 2/2016 Vigneault
2017/0145657 A1 * 5/2017 Erhardt ..... E02F 9/00
2017/0218597 A1 * 8/2017 Holman ..... E01C 23/08
2018/0127935 A1 * 5/2018 Paonessa ..... E01H 5/065

* cited by examiner

PLOW ASSEMBLY WITH WINGS

CROSS REFERENCE TO RELATED APPLICATION

The present application claims the filing benefits of U.S. provisional application Ser. No. 62/355,461, filed Jun. 28, 2016, which is hereby incorporated herein by reference in its entirety.

FIELD OF THE INVENTION

The present invention relates generally to plows that attach to a vehicle, such as a skid steer or the like, and are operable to move snow or other materials.

BACKGROUND OF THE INVENTION

It is known to provide a plow at a vehicle. It is also known to provide adjustable wings at one or both ends of a main plow blade, in order to adjust the length of the plow. Such wings are movably disposed at the ends of the main plow blade and are individually controlled to provide the desired plow configuration. In order to control the wings, additional hydraulic circuits and electronic controls are needed at the plow assembly with corresponding user controls in the vehicle. In some cases, the wings are fixedly or non-adjustably attached at the ends of the main plow, and include struts or other attachments at the front of the main plow to retain the wings.

SUMMARY OF THE INVENTION

The present invention provides a plow assembly having plow wings that are non-adjustably attached at the ends of a main plow moldboard. The wings are attached via elastomeric or resilient elements that allow for the wings to be pivoted or urged or forced inward or outward, such as in response to impact with an object during plowing. The resilient attachment elements allow the wings to absorb the impact and return the wings to the normal position generally normal to the main plow. The attachment means or attachment assemblies are disposed entirely rearward of the curved plowing front surface of the center plow or moldboard, so as to not interfere with the curved plowing surface to provide enhanced plowing of snow or other materials by the center plow and plow assembly.

According to an aspect of the present invention, a plow assembly comprises a mounting structure configured to mount at a vehicle, and a center or main plow pivotally attached at the mounting structure. A plow wing is mounted at an end of the center plow via a first attachment assembly and a second attachment assembly (with the plow assembly preferably including a plow wing mounted at each end of the center plow), with each of the first and second attachment assemblies comprising an elongated attachment element (such as a bolt or rod or the like) and a biasing element (such as a resilient compressible and/or stretchable element). The elongated attachment element attaches a respective rear portion of the plow wing at the center plow, and the biasing element allows for movement of the attachment element relative to the center plow to allow for pivotal movement of the plow wing relative to the center plow (such as responsive to an impact of the plow wing with an object during plowing). The biasing element limits such pivotal movement of the plow wing and biases the plow wing towards a neutral or non-angled state, where the plow wing is generally normal to the center plow.

The attachment element extends through a fixed portion of the center plow and further through the biasing element, such that outward movement of the attachment element (when the plow wing pivots) compresses the biasing element at the fixed portion of the center plow. The first attachment assembly may be disposed forward of the second attachment assembly and at a level above the second attachment assembly. When the plow wing pivots inwardly relative to the center plow, the biasing element of the second attachment assembly compresses more than the biasing element of the first attachment assembly, and when the plow wing pivots outwardly relative to the center plow, the biasing element of the first attachment assembly compresses more than the biasing element of the second attachment assembly.

Optionally, the elongated attachment element of the first attachment assembly may be received through an arcuate slot of the plow wing and the elongated attachment element of the second attachment assembly is received through a circular aperture of the plow wing, such that the plow wing is pivotable about a generally horizontal longitudinal axis of the elongated attachment element of the second attachment assembly and thus can pivot between a lowered position and a raised position.

Therefore, the present invention provides a plow assembly having plow wings that are attached at the ends of the center plow and pivotable or movable responsive to impact with an object. The plow assembly and plow wings are configured to allow inward or outward pivotal movement of the plow wings, whereby the attachment assemblies bias the plow wings toward their straight configuration, whereby, after impact with an object, the plow wing is returned to its normal state where it is generally normal to the main plow. Also, the attachment assemblies are located entirely rearward of the main plow moldboard, and thus do not interfere with the curved plowing surface of the moldboard. By eliminating or avoiding use of struts or the like that extend forward of the center plow to support the forward end region of the plow wing, the attaching assemblies of the present invention significantly improves the rolling motion of snow upward along the center plow during plowing of snow (or other material). Thus, the plow wings and attachment assemblies of the present invention allow for controlled limited pivoting of the plow wings (such as when one of the plow wings impacts an object during plowing) while allowing the curved moldboard to plow the snow or other material in an efficient and effective manner (without struts or other elements disposed at the moldboard to retain the plow wings at the moldboard).

These and other objects, advantages, purposes and features of the present invention will become apparent upon review of the following specification in conjunction with the drawings.

DESCRIPTION OF THE PREFERRED EMBODIMENTS

Figure 1:
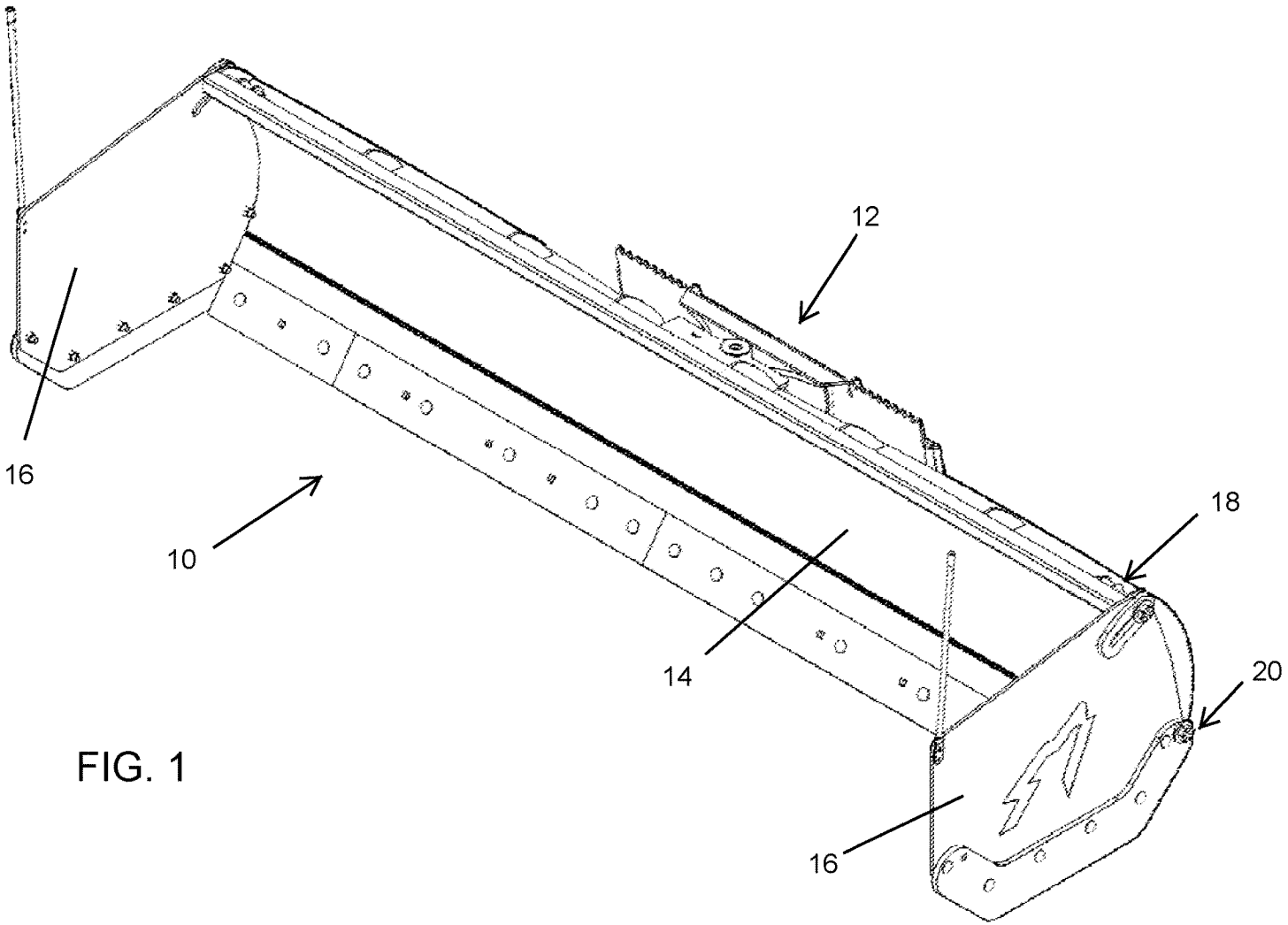
FIG. 1 is a perspective view of a plow assembly in accordance with the present invention, shown with the wings in their normal position generally normal to the main plow.
Figure 2:
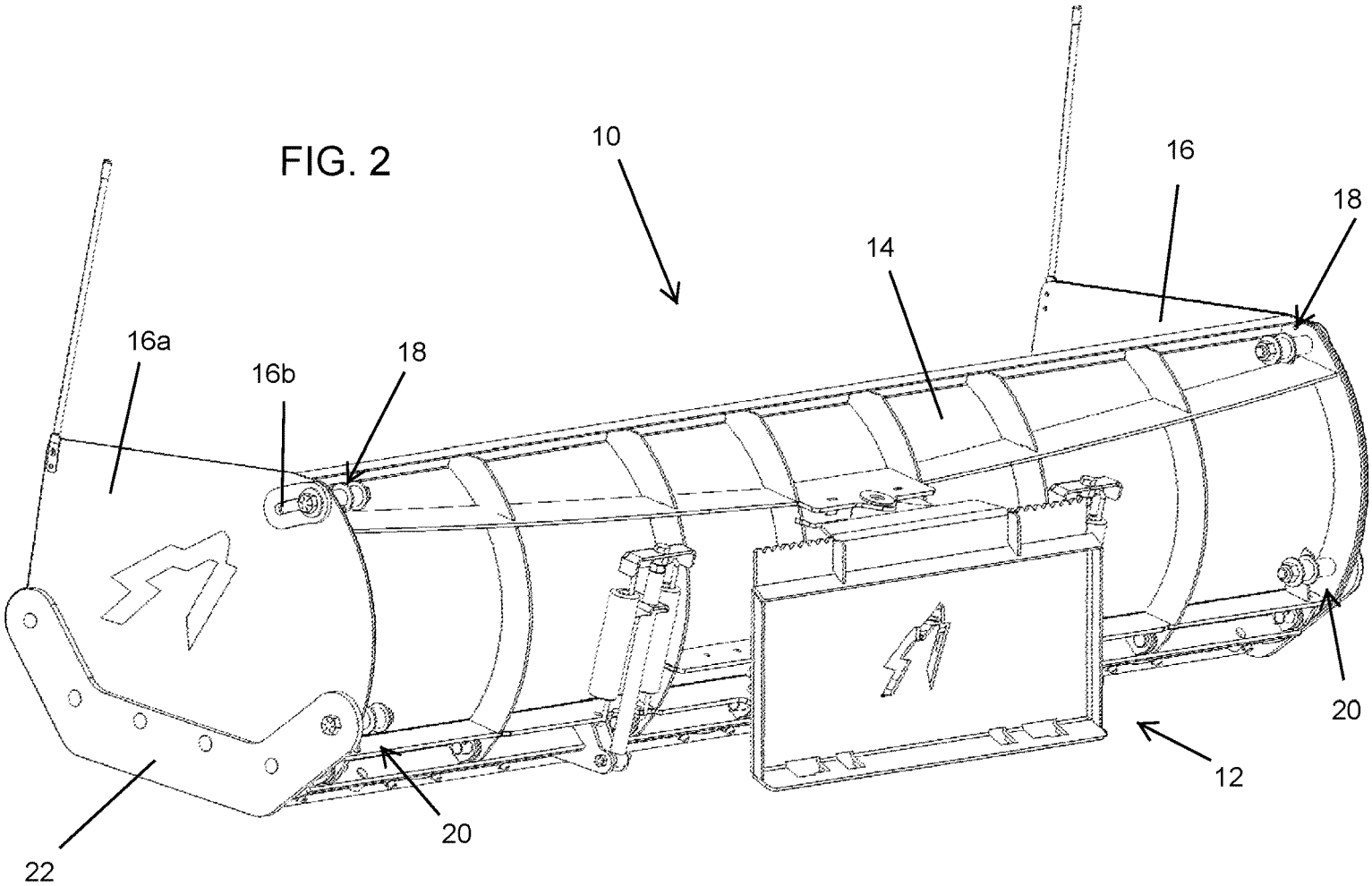
FIG. 2 is a rear perspective view of the plow assembly of FIG. 1.
Figure 3:
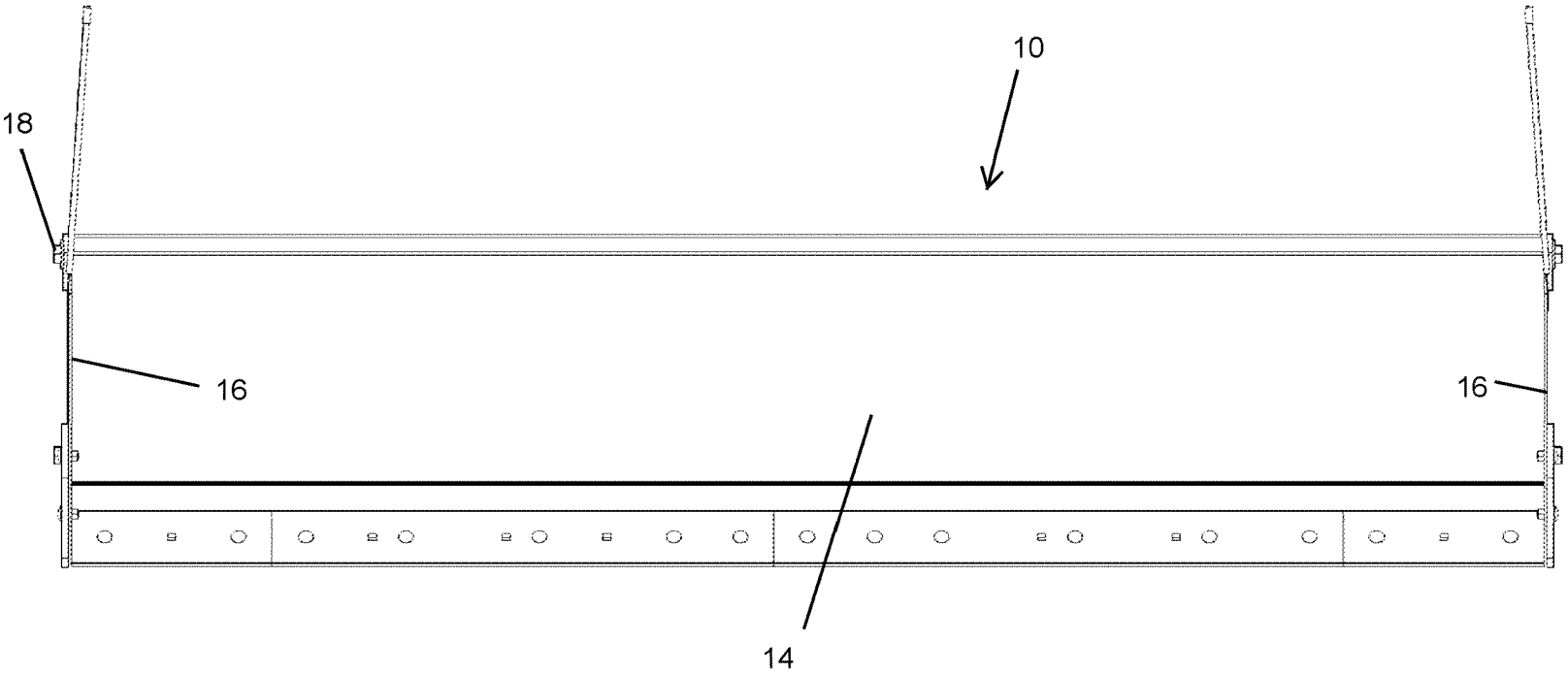
FIG. 3 is a front plan view of the plow assembly of FIG. 1.

Referring now to the drawings and the illustrative embodiments depicted therein, a plow assembly 10 is configured to be mounted to a vehicle (not shown), such as a skid steer or pickup truck or other movable vehicle or the like, via a support 12, such as an A-frame support or the like (FIGS. 1-6). The plow assembly 10 includes a main or center plow 14 that is mounted at the support 12 (and may be pivotable side to side about a generally vertical pivot axis, such as via actuation of a respective one of two actuators or hydraulic cylinders or the like). Plow assembly 10 includes plow wings 16 mounted at opposite ends of the center plow 14. The plow wings 16 are movably attached at the plow 14 via a pair of attachment assemblies 18, 20, which hold the plow wings in a position generally normal to the plow 14 and which allow the plow wings to pivot inward or outward relative to the center plow (such as upon impact with an object during plowing), as discussed below.

Figure 14:
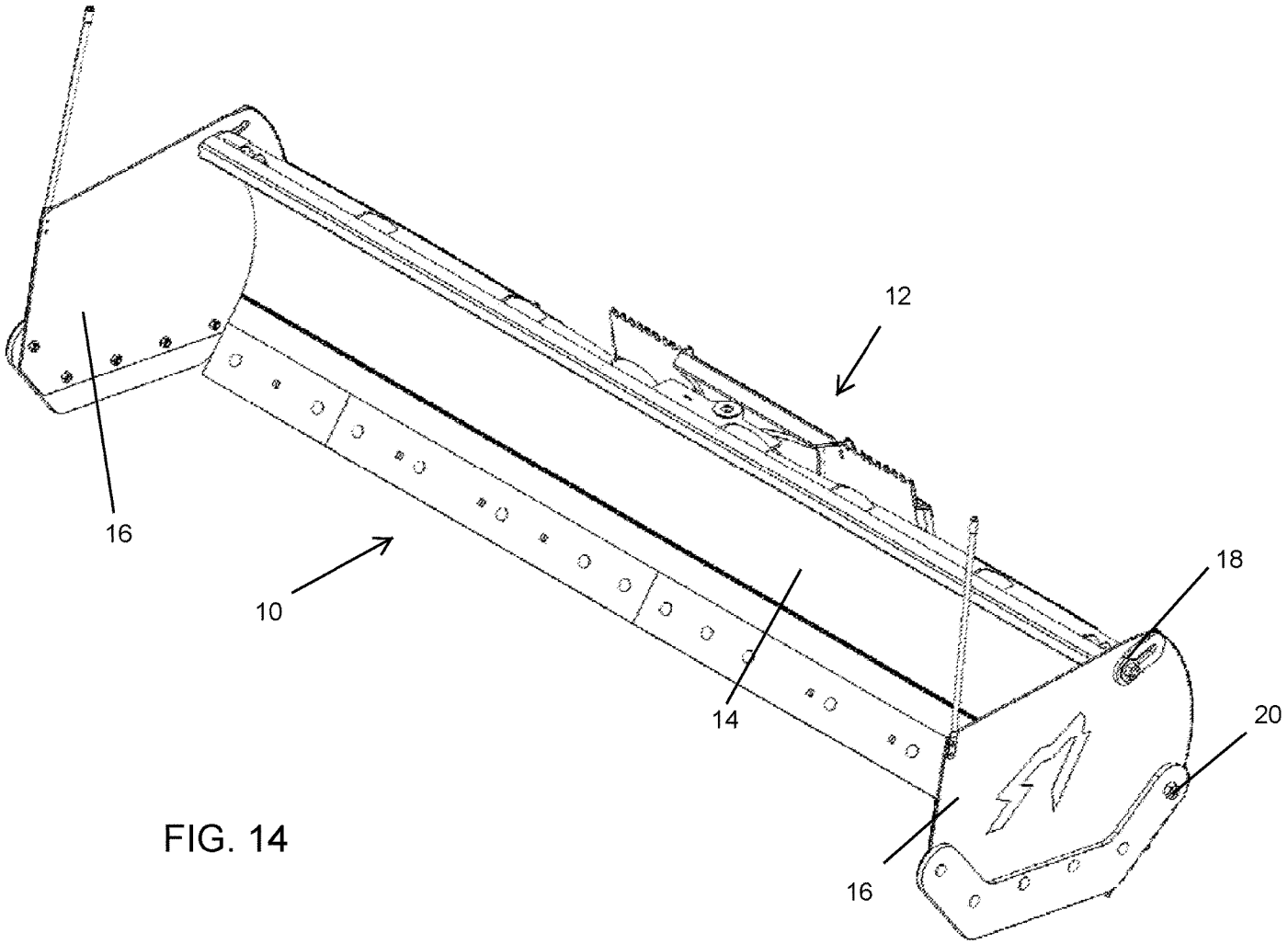
FIG. 14 is a front perspective view of the plow assembly of the present invention, shown with the plow wings angled upward.
Figure 15:
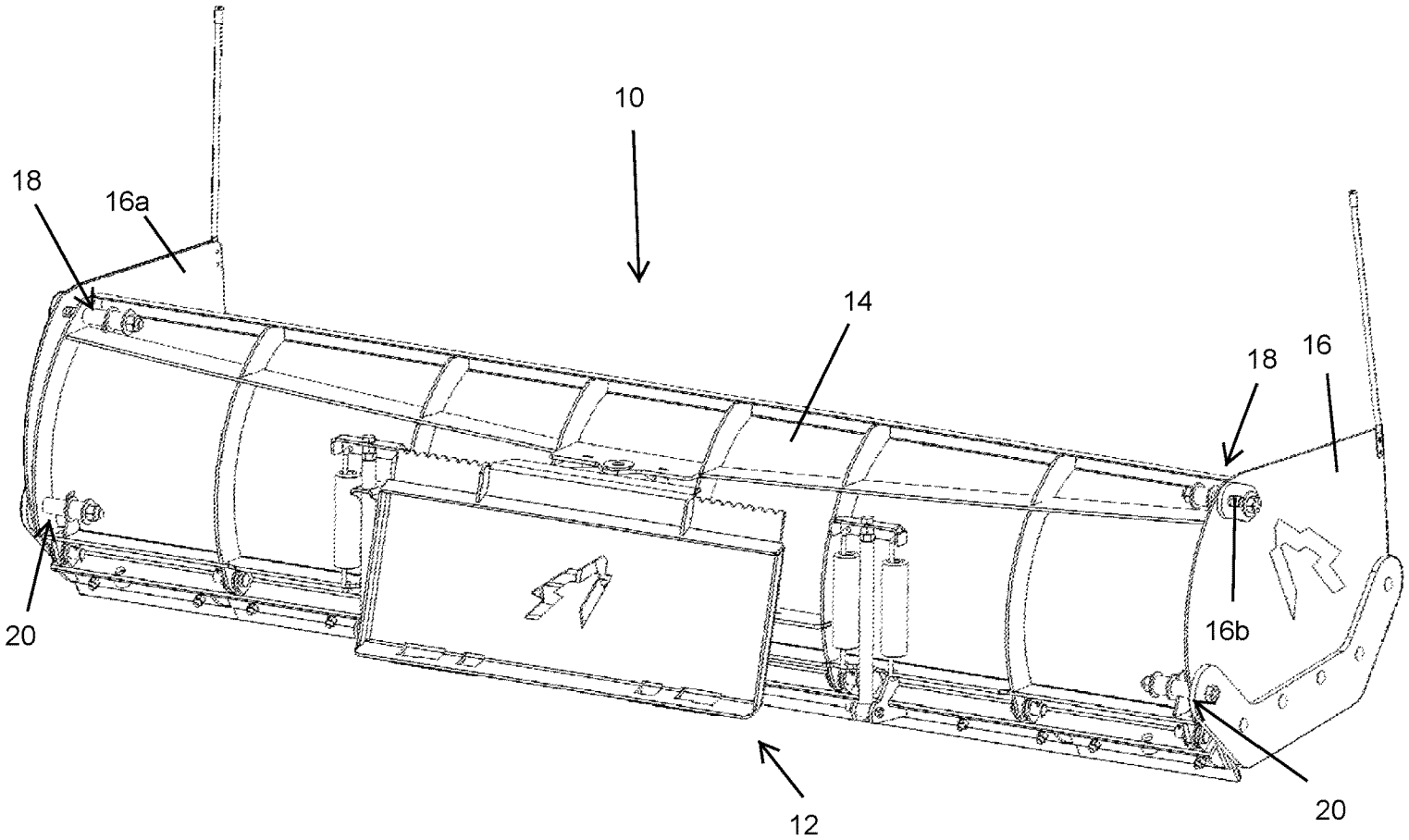
FIG. 15 is a rear perspective view of the plow assembly of FIG. 14.
Figure 16:
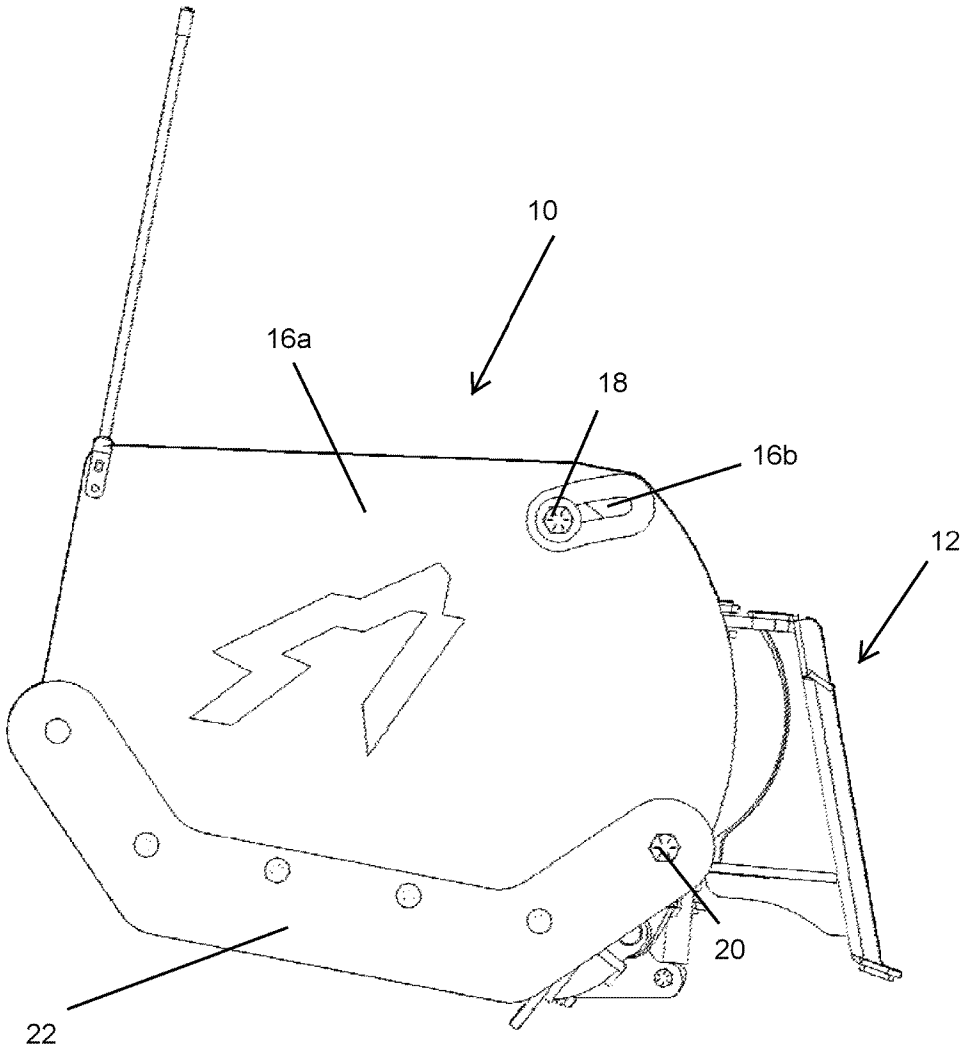
FIG. 16 is a side elevation of the plow assembly of FIG. 14.

Each of the plow wings 16 comprises a generally flat metal plate 16*a* that is attached at its rear portion to the center plow 14 via the attachment assemblies 18, 20. Each of the plow wings 16 may also include a lower edge element 22 attached at the bottom of the flat metal plate 16*a* to provide additional strength to the plow wing as it moves along the ground. In the illustrated embodiment, the plow wings are pivotally attached to the center plow via the lower attachment assembly 20, while the upper attachment assembly 18 is received in an arcuate slot 16*b* of the plate 16*a*. Such a mounting configuration allows for the plow wing to pivot about the generally horizontal longitudinal axis of the lower attachment assembly 20, so as to allow the plow wing to pivot relative to the main plow 14 from a lowered position (FIGS. 1-7) to an upward position (see FIGS. 14-16), such as when the plow wing impacts an object during plowing.

In the illustrated embodiment, the wing attachment assemblies 18, 20 comprise elongated bolts or fasteners or elements 18*a*, 20*a* (such as threaded bolts), which are received through the respective plow wing (such as through the slot 16*b* or through a lower hole or aperture) and through a flange 14*a* at the end of the main plow (and rearward of the front curved plowing surface of the main plow) and through a respective bracket 18*b*, 20*b* at the rear of the main plow 14. The bolts 18*a*, 20*a* are further received through a resilient element or biasing element or bushing 18*c*, 20*c* disposed between the bracket 18*b*, 20*b* and a washer 18*d*, 20*d*, with a nut or fastener 18*e*, 20*e* threadedly fastening or securing to the bolt 18*a*, 20*a* at the washer, so as to retain the bolt 18*a*, 20*a* and resilient element 18*c*, 20*c* at the bracket 18*b*, 20*b* of the plow 14.

The attachment assemblies 18, 20 retain the plow wing 16 at the side or end of the main plow 14, and allow for limited pivoting of the plow wing 16 relative to the main plow 14. The brackets 18*b*, 20*b* at the rear of the center plow 14 are fixed, such that, when the bolt 18*a*, 20*a* is pulled outwardly from the flange 14*a*, the fastener 18*e*, 20*e* and washer 18*d*, 20*d* are pulled towards the bracket 18*b*, 20*b* to compress the resilient element 18*c*, 20*c*. The resilient or biasing elements 18*c*, 20*c* compress responsive to pivoting of the plow wing relative to the main plow, and are biased toward their initial state or form, such that they urge and bias the plow wing 16 towards its neutral state. However, when the plow wing impacts an object that imparts an inward or outward force at the plow wing, the biasing elements 18*c*, 20*c* compress to allow for pivoting of the plow wing relative to the main plow.

Figure 4:
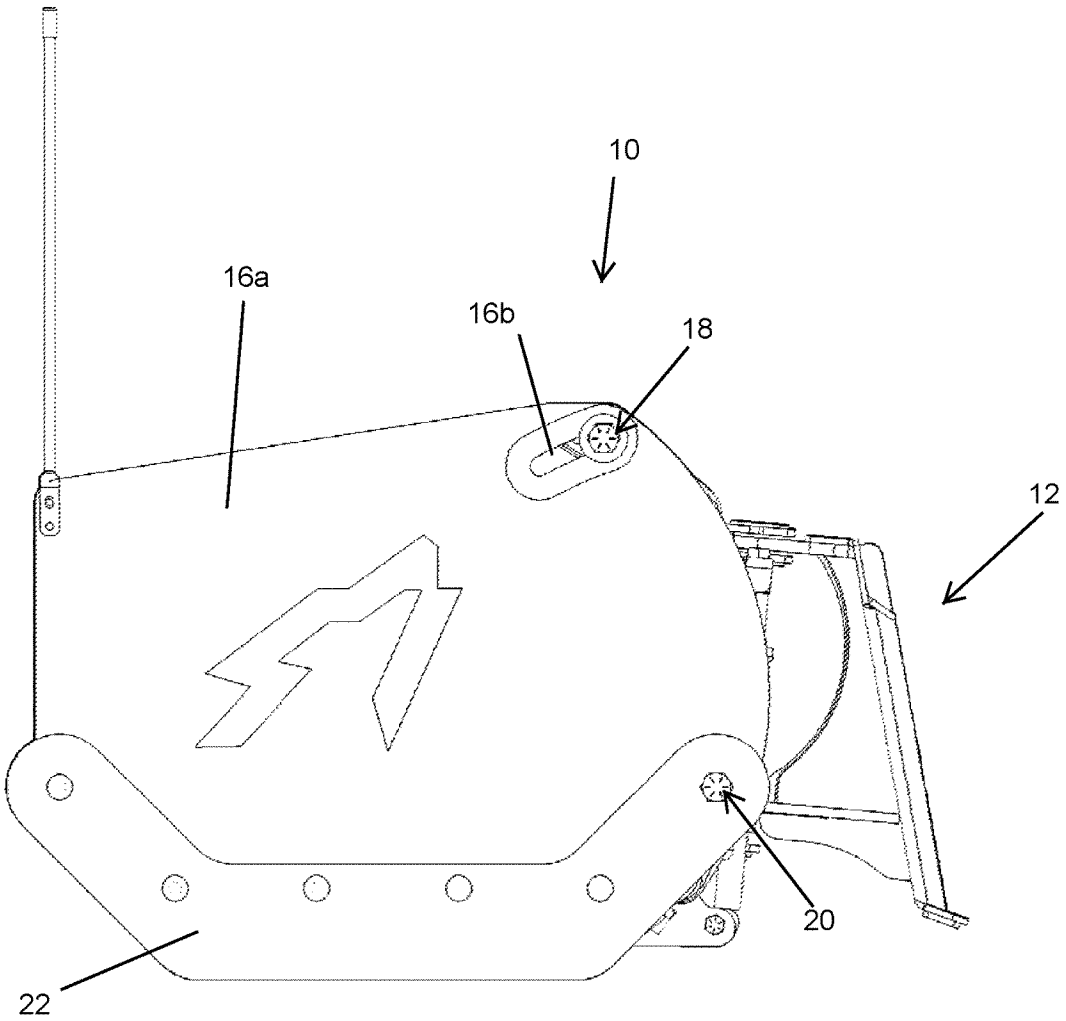
FIG. 4 is a side elevation of the plow assembly of FIG. 1.
Figure 5:
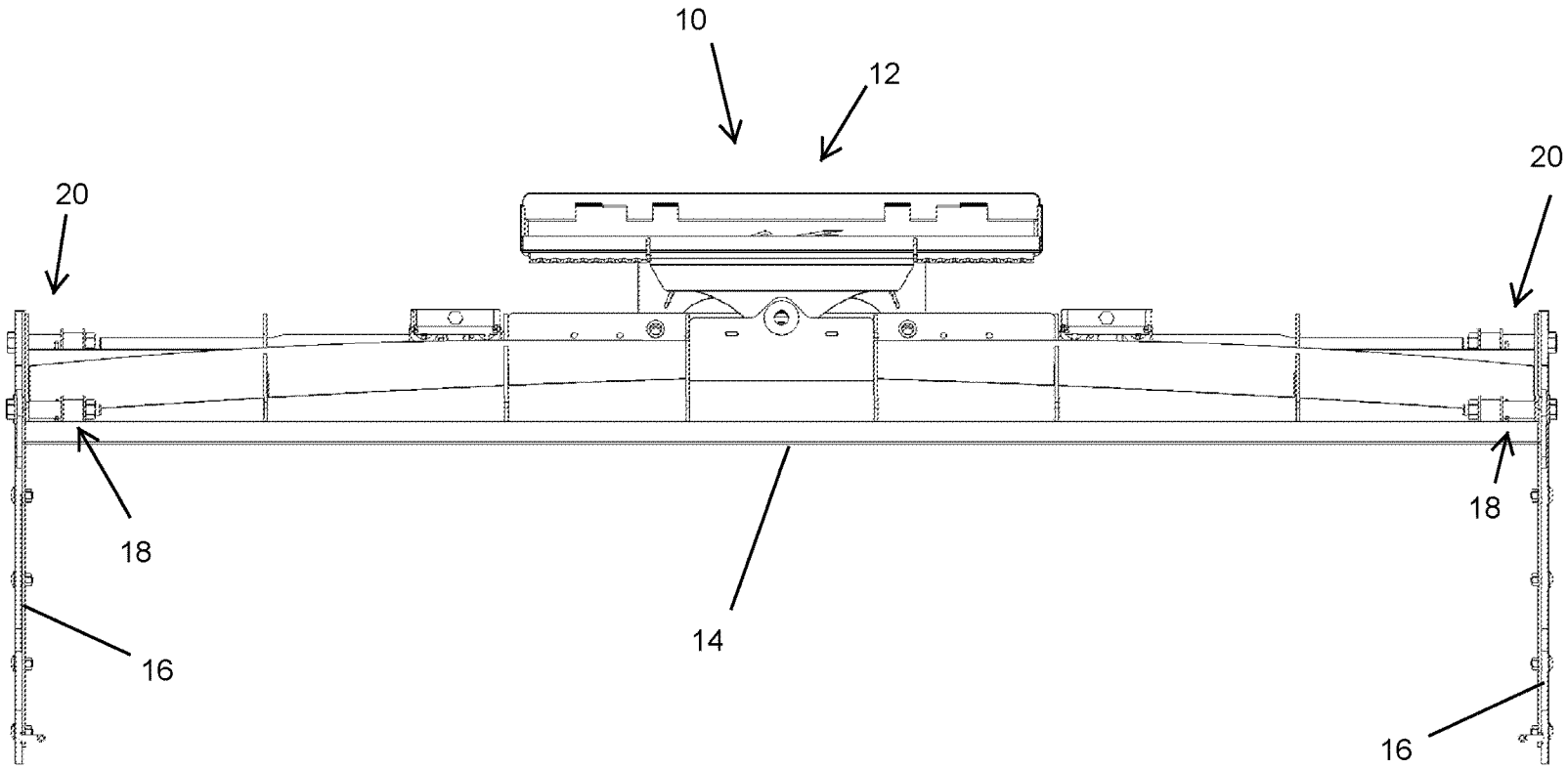
FIG. 5 is a top plan view of the plow assembly of FIG. 1.
Figure 6:
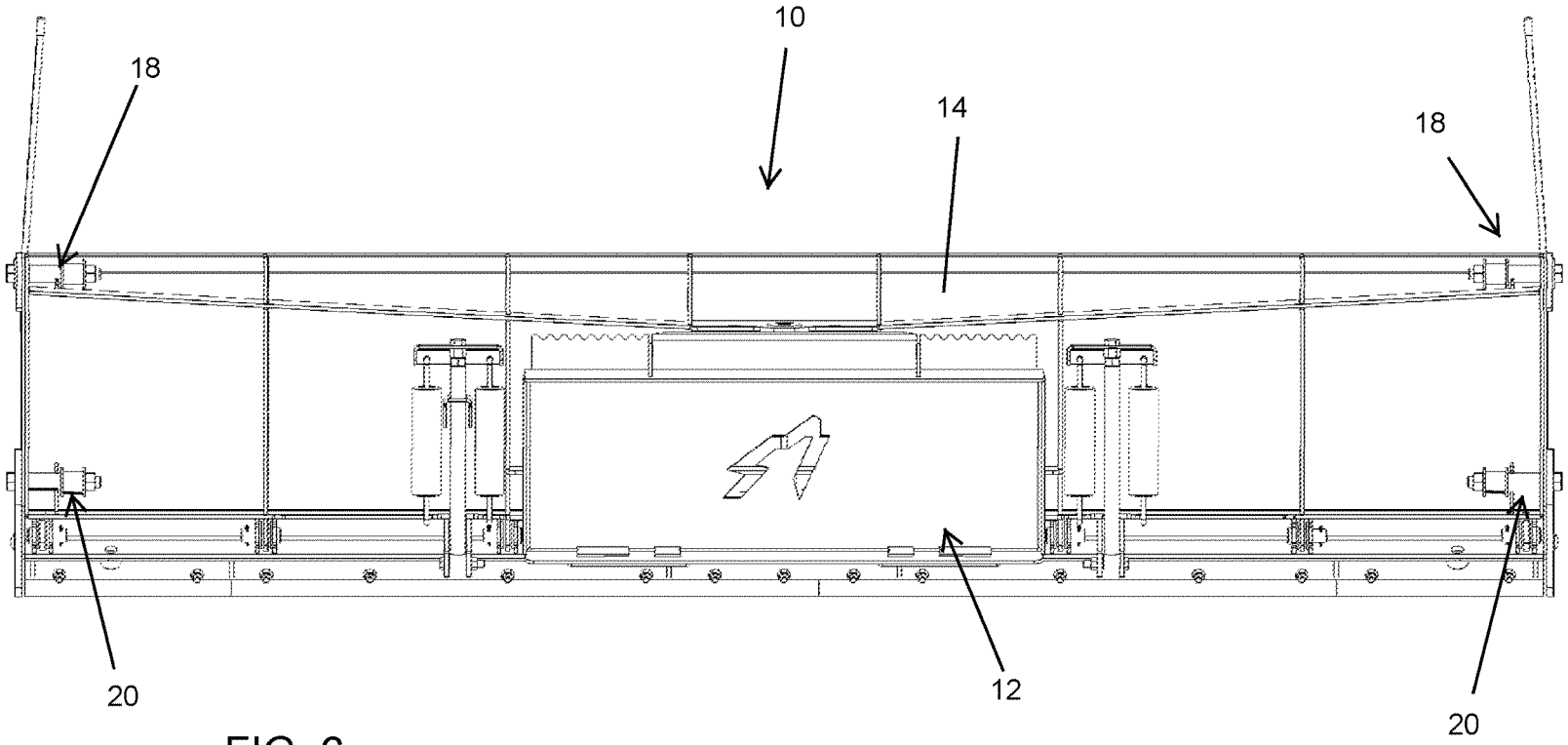
FIG. 6 is a rear plan view of the plow assembly of FIG. 1.
Figure 7:
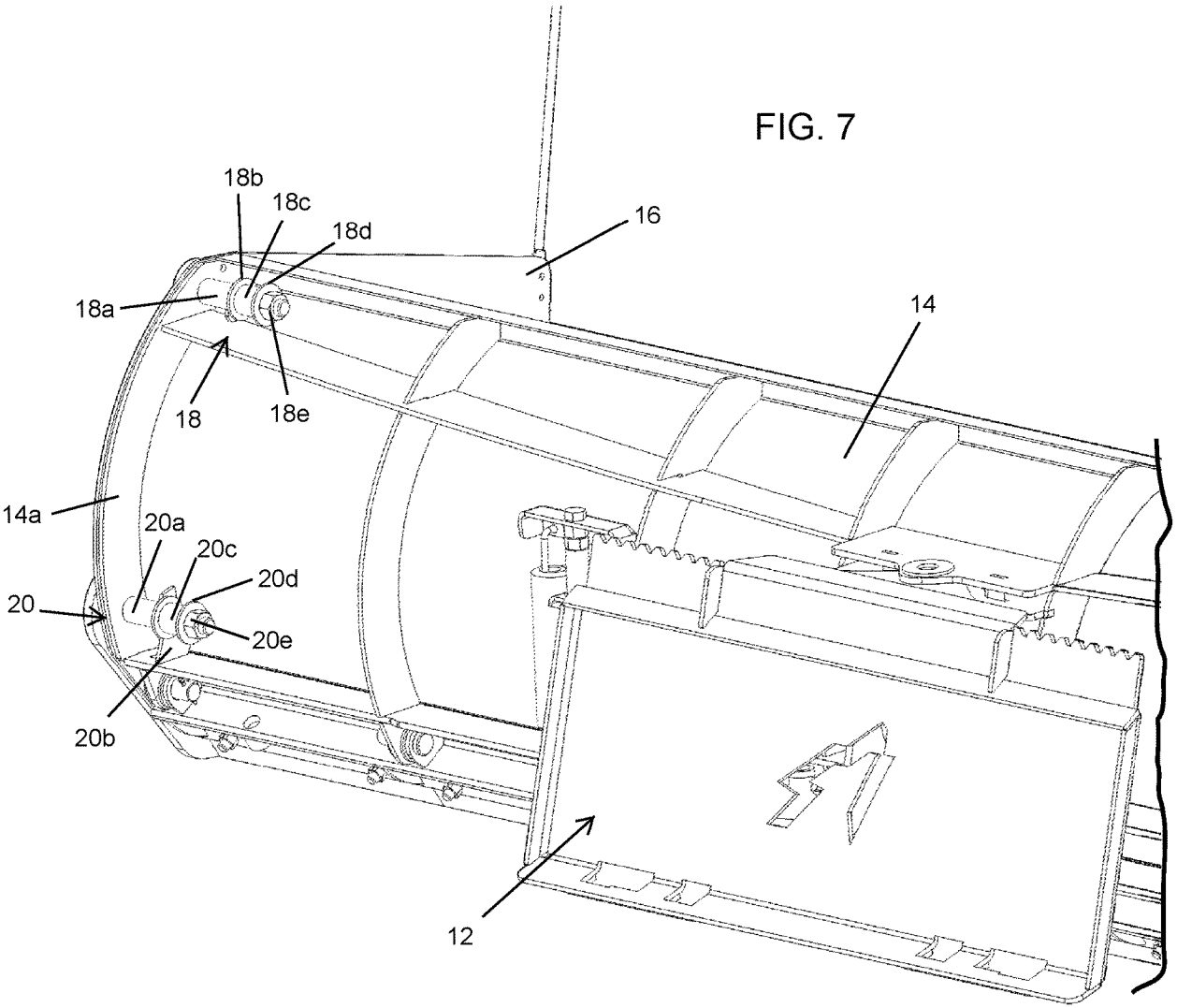
FIG. 7 is an enlarged rear perspective view of the plow assembly of FIG. 1.
Figure 8:
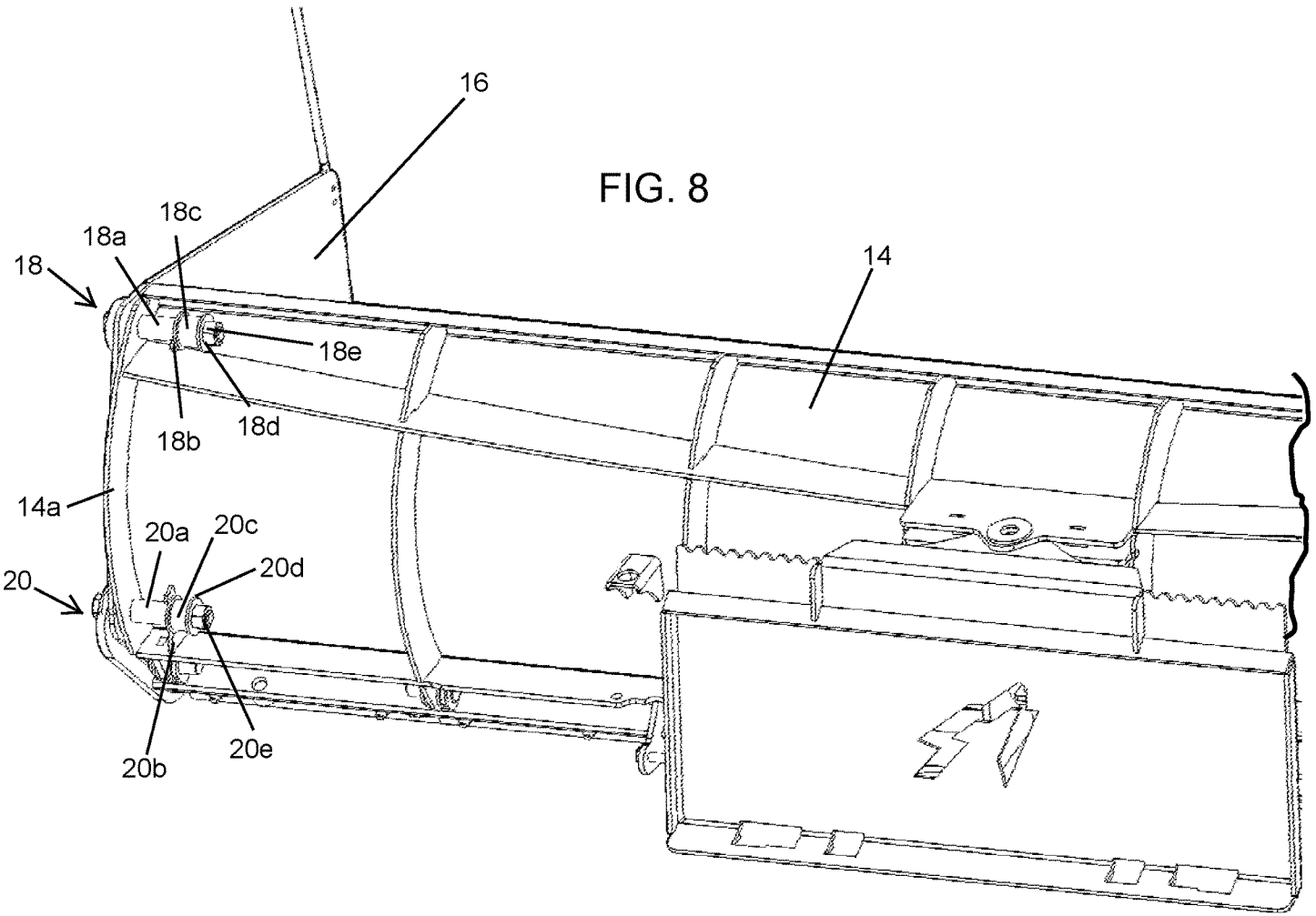
FIG. 8 is a partial rear perspective view of the plow assembly of the present invention, shown with the plow wing compressed and angled inward.
Figure 9:
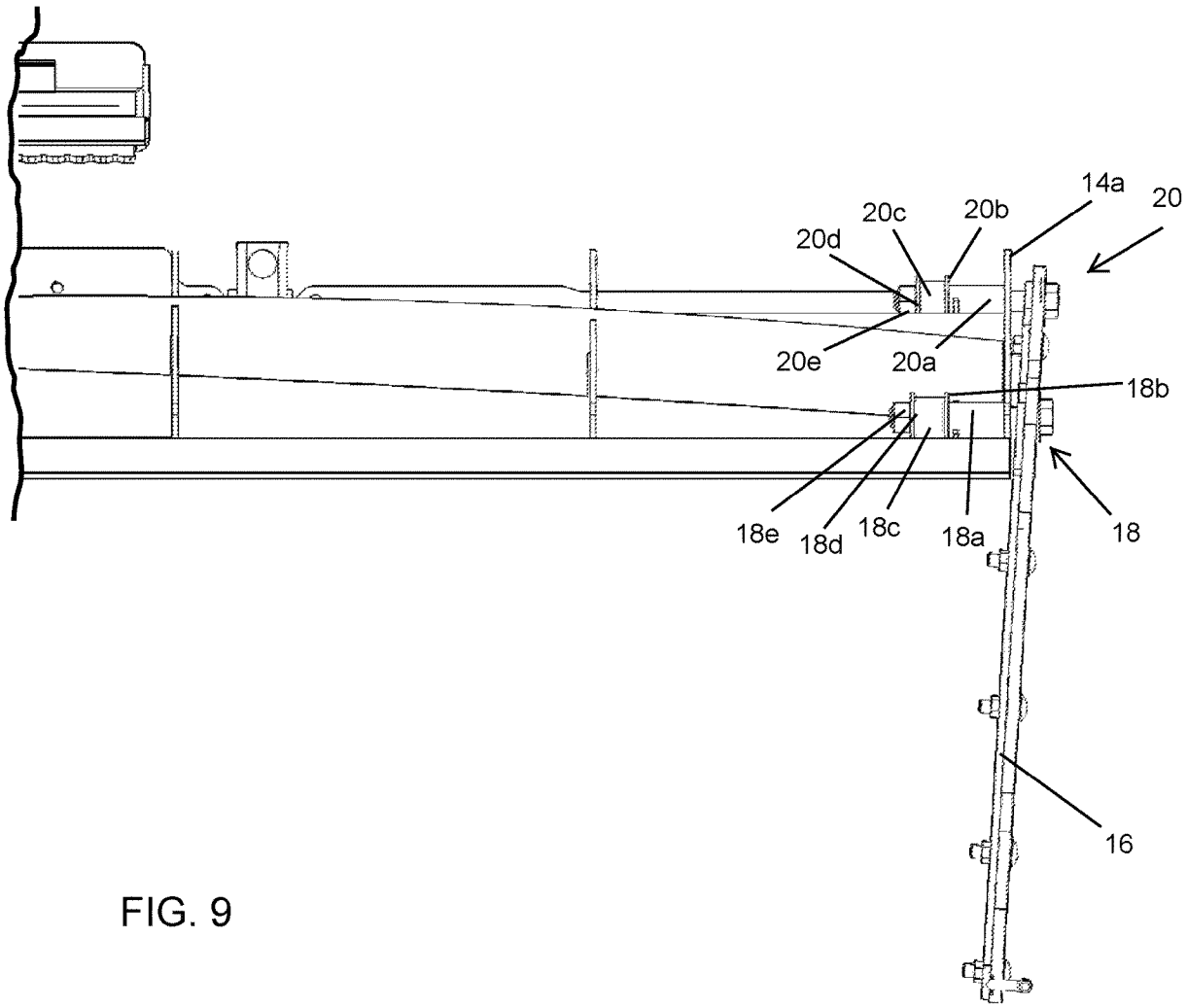
FIG. 9 is a top plan view of the plow assembly of FIG. 8.
Figure 10:
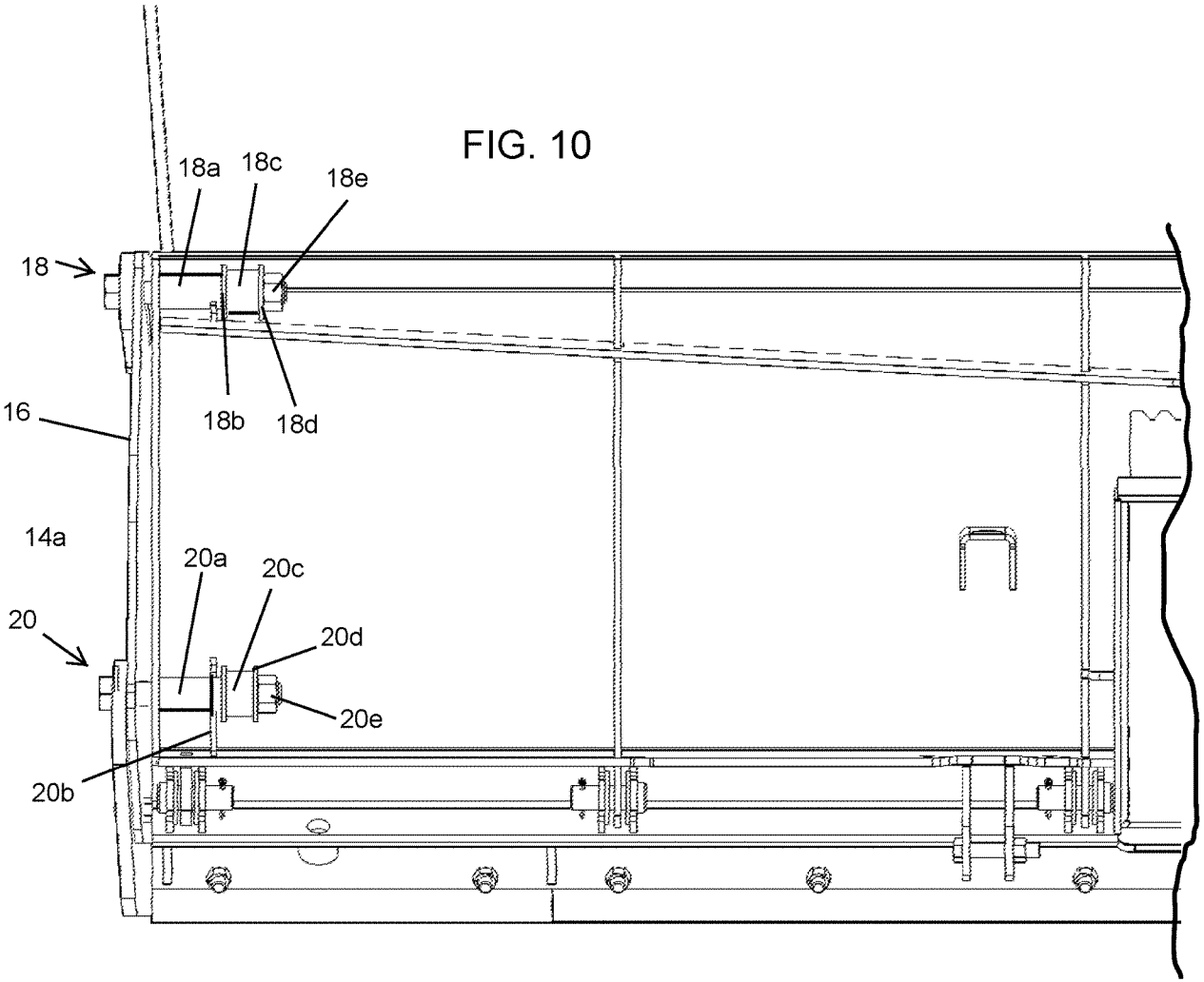
FIG. 10 is a rear plan view of the plow assembly of FIG. 8.

For example, and such as can be seen with reference to FIGS. 8-10, when the plow wing is pushed or forced inwardly (such as when the plow wing strikes an object at its outer side), the biasing element 20*c* of the lower attachment assembly 20 (which is rearward of the upper attachment element 18, as can be seen in FIGS. 4 and 9) compresses between the washer and the bracket as the bolt 20*a* is pulled outward from the flange 14*a* of the main plow 14. As best shown in FIG. 9, the biasing element 18*c* of the upper attachment assembly 18 (which is forward of the lower attachment element 20), may slightly compress as the bolt 18*a* may also be slightly pulled from the flange 14*a*, depending on where the forward most point of contact is between the plow wing and the main plow. In other words, if the upper attachment element 18 is generally at the forward most point of contact, then the plow wing may pivot at that point and thus only slightly pull the bolt 18*a* outward and thus only slightly compress the biasing element 18*c*, but if the plow wing contacts the main plow substantially forward of the upper attachment assembly 18, then both bolts 18*a*, 20*a* may be pulled outward and both biasing elements 18*c*, 20*c* may be compressed (with the rearward biasing element being compressed more than the forward biasing element).

Figure 11:
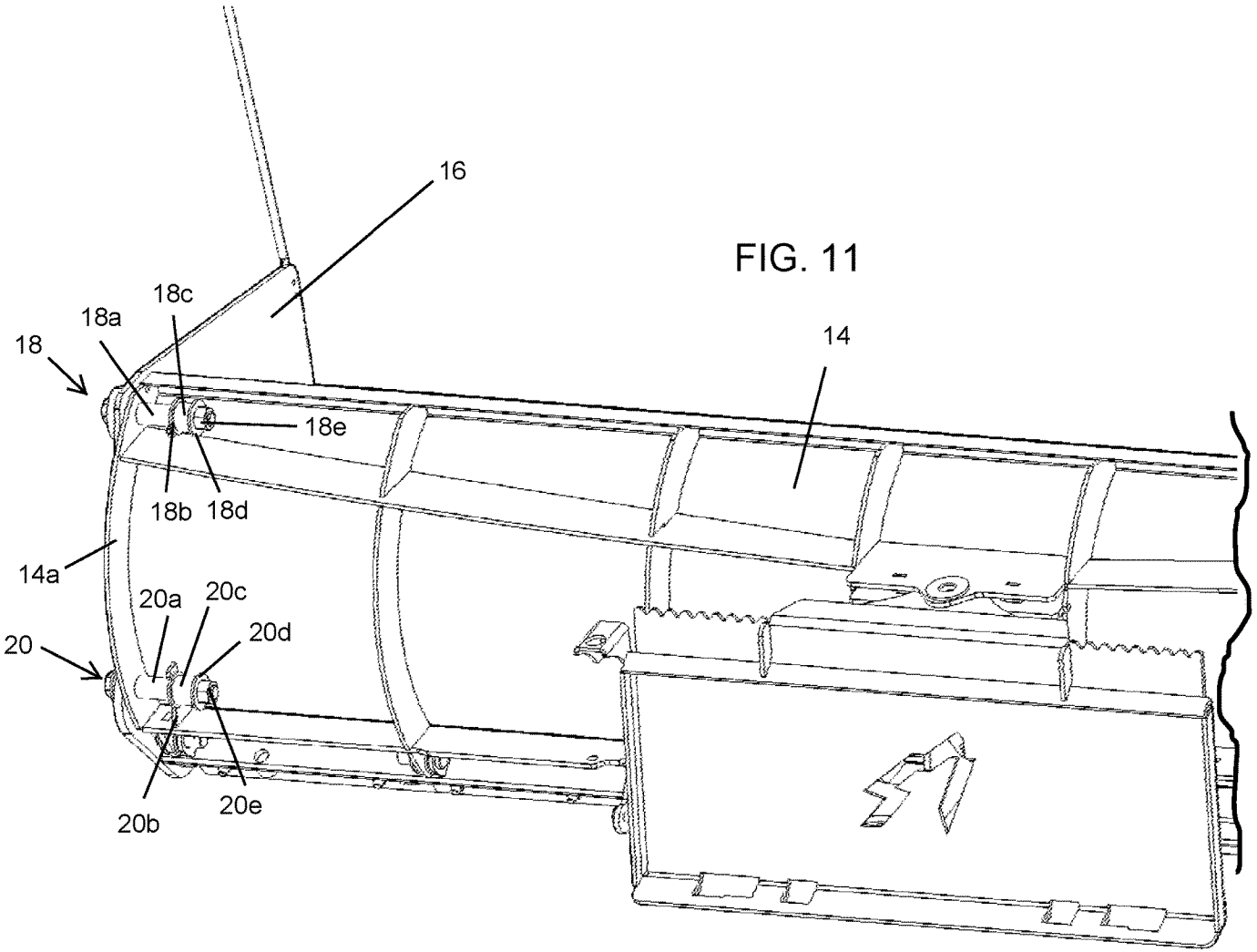
FIG. 11 is a partial rear perspective view of the plow assembly of the present invention, shown with the plow wing angled outward.
Figure 12:
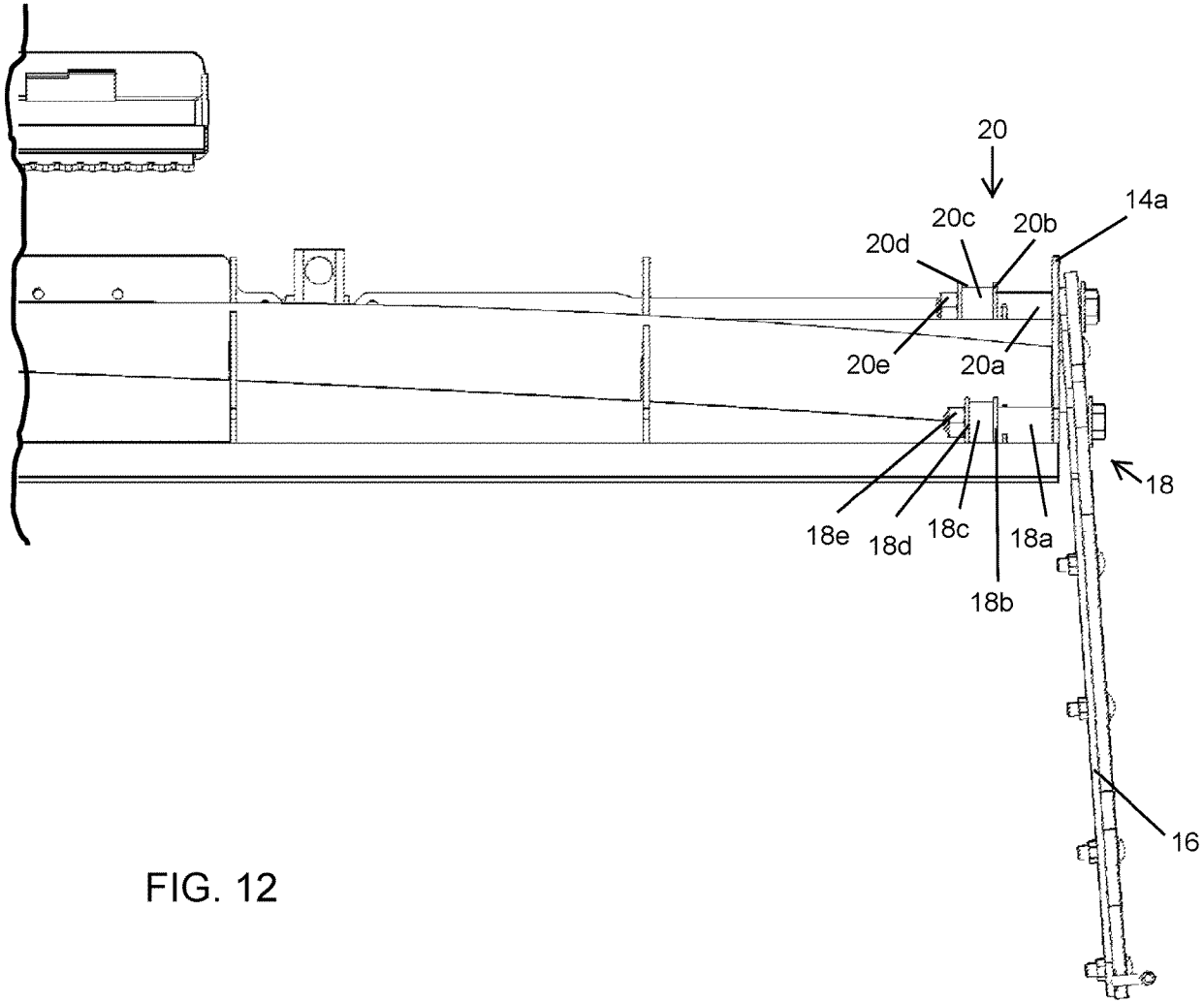
FIG. 12 is a top plan view of the plow assembly of FIG. 11.
Figure 13:
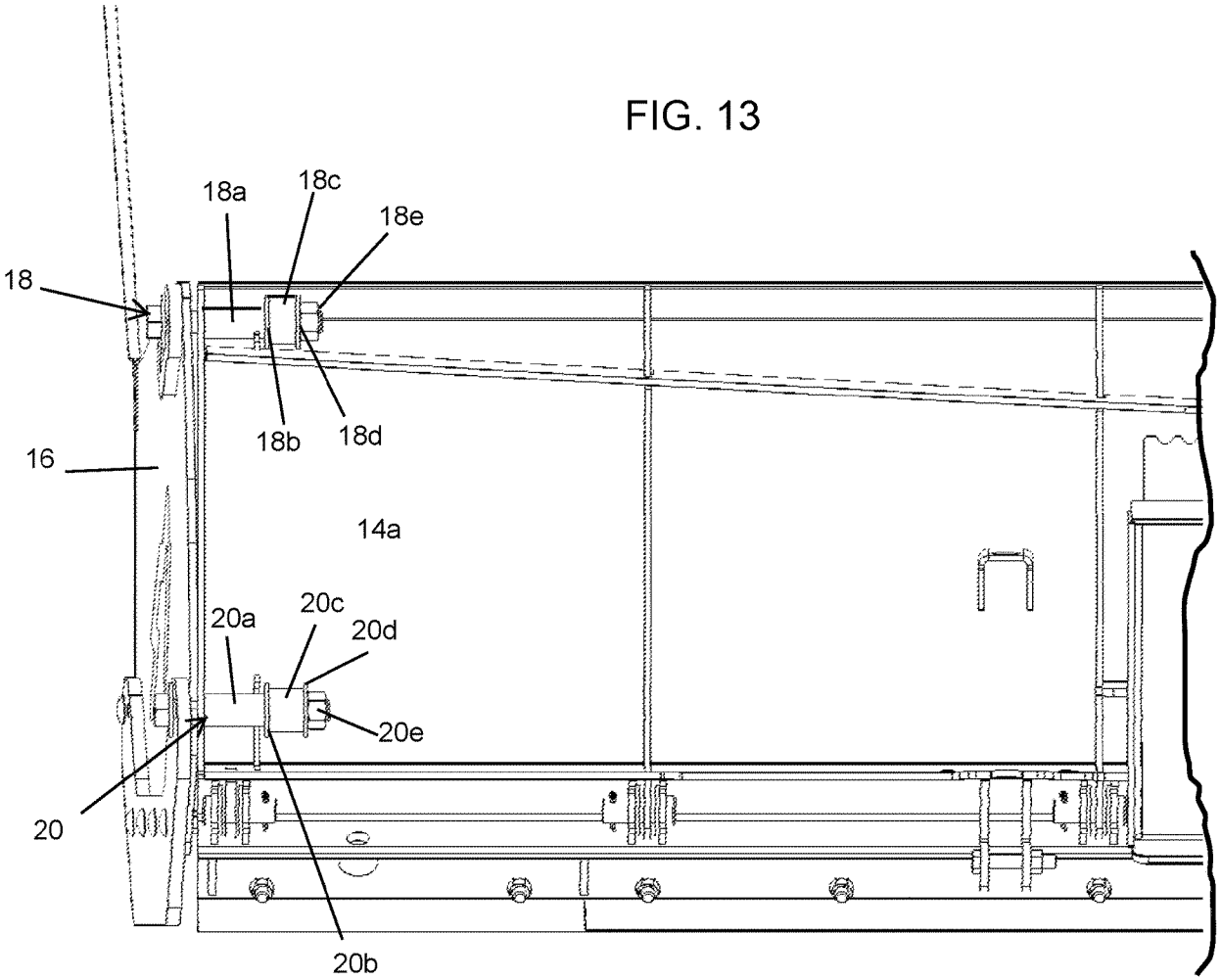
FIG. 13 is a rear plan view of the plow assembly of FIG. 11.

Also, for example, and such as can be seen with reference to FIGS. 11-13, when the plow wing is pushed or forced outwardly (such as when the plow wing strikes an object at its inner side), the biasing element 18*c* of the upper attachment assembly 18 compresses as the bolt 18*a* is pulled outward from the flange 14*a* of the main plow 14 (such as best shown in FIG. 12). As shown in FIG. 12, the biasing element 20*c* of the lower attachment assembly 20 (which is rearward of the upper attachment element 18), may slightly compress as the bolt 20*a* is slightly pulled from the flange 14*a*, depending on where the rearward most point of contact is between the plow wing and the main plow. In other words, if the lower attachment element 20 is generally at the rearward most point of contact, then the plow wing may pivot at that point and thus only slightly pull the bolt 20*a* outward and thus only slightly compress the biasing element 20*c*, but if the plow wing contacts the main plow substantially rearward of the lower attachment assembly 20, then both bolts 18*a*, 20*a* may be pulled outward and both biasing elements 18*c*, 20*c* may be compressed (with the forward biasing element being compressed more than the rearward biasing element).

In the illustrated embodiment, the biasing elements 18*c*, 20*c* are selected and sized so that the amount of compression of the biasing element allows for the front end of the plow wing to pivot inward by up to about 10 inches (see FIG. 9) or outward by up to about 10 inches (see FIG. 12). The biasing elements 18*c*, 20*c* may comprise any suitable compressible, resilient biasing material, such as a compressible or deformable elastomeric material or rubber material or the like. Optionally, the biasing elements 18*c*, 20*c* may comprise coil springs or the like, while remaining within the spirit and scope of the present invention.

By spacing the bracket 18*b*, 20*b* from the flange 14*a* of the center plow, the holes of the bracket and flange assist in maintaining the bolt or element 18*a*, 20*a* in its generally horizontal orientation. Optionally, however, the biasing element may be compressed between the flange at the end of the center plow and the washer at the end of the bolt (without the additional bracket at the rear of the plow). Optionally, the attachment assembly may include a bushing or spacer between the bracket 18*b*, 20*b* and the flange 14*a*, whereby the bolt 18*a* passes through the bushing or spacer, with the spacer providing enhanced strength and rigidity to the assembly. Optionally, the inboard end of the biasing element (the end furthest from the respective plow wing) may be fixedly attached at a bracket of the plow (that is spaced from the end flange of the plow) and an outboard end of the biasing element may be attached at the elongated element or bolt, whereby the biasing element may stretch or extend (instead of compressing) when the plow wing is pivoted relative to the center plow, while remaining within the spirit and scope of the present invention.

Therefore, the present invention provides a plow assembly having plow wings that are attached at the ends of the center plow and pivotable or movable responsive to impact with an object. The plow assembly and plow wings are configured to allow inward or outward pivotal movement of the plow wings, whereby the attachment elements bias the plow wings toward their initial or neutral or straight configuration so as to return the plow wing or wings to be generally normal to the main plow after the impact with the object. The attachment assemblies that allow for the limited pivotal movement of the plow wings are located entirely rearward of the main plow moldboard, and thus do not interfere with the curved plowing surface of the moldboard. By eliminating or avoiding use of struts or the like that extend forward of the center plow to support the forward end region of the plow wing and that thus are in the path of motion of the material being plowed and interfere with the movement of the material, the plow wings and attaching/biasing assemblies of the present invention significantly improves the rolling motion of snow upward along the center plow during plowing of snow (or other material). Thus, the plow wings and attachment assemblies of the present invention allow for controlled limited pivoting of the plow wings (such as when one of the plow wings impacts an object during plowing) while allowing the curved moldboard to plow the snow or other material in an efficient and effective manner (without struts or other elements disposed at the moldboard to retain the plow wings at the moldboard).

Changes and modifications in the specifically described embodiments may be carried out without departing from the principles of the present invention, which is intended to be limited only by the scope of the appended claims as interpreted according to the principles of patent law.

The invention claimed is:

1. A plow assembly comprising:

a mounting structure configured to mount at a vehicle;

a center plow attached at said mounting structure;

a plow wing mounted at an end of said center plow via a first attachment assembly and a second attachment assembly;

wherein each of said first and second attachment assemblies comprises an elongated attachment element and a biasing element, and wherein said elongated attachment element attaches a respective rear portion of said plow wing at said center plow and engages the respective biasing element at the rear of said center plow;

wherein said biasing elements limit pivotal movement of said plow wing and bias said plow wing towards a neutral state, where said plow wing is normal to said center plow;

wherein said biasing elements allow for movement of the respective elongated attachment elements at the rear of said center plow to allow for pivotal movement of said plow wing from the neutral state and relative to said center plow; and wherein said elongated attachment element of said first attachment assembly is received through an arcuate slot, and wherein said plow wing is pivotable about a horizontal axis at or near said second attachment assembly via movement of said elongated attachment element of said first attachment assembly along said arcuate slot.

2. The plow assembly of claim 1, wherein, with said mounting structure mounted at the vehicle, said plow wing is pivoted relative to said center plow responsive to an impact of said plow wing with an object during plowing.

3. The plow assembly of claim 2, wherein said first and second attachment assemblies allow for limited pivotal movement of said plow wing inward and outward relative to said center plow.

4. The plow assembly of claim 1, comprising a plow wing at each of said ends of said center plow.

5. The plow assembly of claim 1, wherein said first attachment assembly is disposed forward of said second attachment assembly.

6. The plow assembly of claim 5, wherein, when said plow wing pivots inwardly relative to said center plow, said biasing element of said second attachment assembly compresses more than said biasing element of said first attachment assembly.

7. The plow assembly of claim 5, wherein, when said plow wing pivots outwardly relative to said center plow, said biasing element of said first attachment assembly compresses more than said biasing element of said second attachment assembly.

8. The plow assembly of claim 5, wherein said first attachment assembly is disposed at an upper portion of said plow wing and said second attachment assembly is disposed at a lower portion of said plow wing.

9. The plow assembly of claim 1, wherein said elongated attachment element extends through a fixed portion of said center plow and further through said biasing element, and wherein outward movement of said elongated attachment element compresses said biasing element at said fixed portion of said center plow.

10. The plow assembly of claim 1, wherein said biasing element comprises a resilient elastomeric element.

11. The plow assembly of claim 1, wherein said plow wing is attached at said center plow only by said first and second attachment assemblies, and wherein said first and second attachment assemblies are disposed rearward of a curved plowing surface of said center plow such that there are no attachments or struts forward of the center plow and in the path of motion of material being plowed.

12. A plow assembly comprising:

a mounting structure configured to mount at a vehicle;

a center plow attached at said mounting structure;

a plow wing mounted at an end of said center plow via a first attachment assembly and a second attachment assembly;

wherein each of said first and second attachment assemblies comprises an elongated attachment element and a biasing element, wherein said elongated attachment element attaches a respective rear portion of said plow wing at said center plow and engages the respective biasing element at the rear of said center plow, and wherein said biasing elements allow for movement of the respective elongated attachment elements at the rear of said center plow to allow for pivotal movement of said plow wing relative to said center plow;

wherein said biasing elements limit pivotal movement of said plow wing and bias said plow wing towards a neutral state, where said plow wing is normal to said center plow;

wherein said first attachment assembly is disposed forward of said second attachment assembly;

wherein said first attachment assembly is disposed at an upper portion of said plow wing and said second attachment assembly is disposed at a lower portion of said plow wing; and wherein said elongated attachment element of said first attachment assembly is received through an arcuate slot of said plow wing and said elongated attachment element of said second attachment assembly is received through a circular aperture of said plow wing, and wherein said plow wing is pivotable about a horizontal longitudinal axis of said elongated attachment element of said second attachment assembly.

13. A plow assembly comprising:

a mounting structure configured to mount at a vehicle;

a center plow attached at said mounting structure;

a plow wing mounted at an end of said center plow via a first attachment assembly and a second attachment assembly;

wherein said first attachment assembly comprises a first elongated attachment element and a first biasing element, and wherein said first elongated attachment element extends through a first fixed portion of said center plow and further through said first biasing element;

wherein said second attachment assembly comprises a second elongated attachment element and a second biasing element, and wherein said second elongated attachment element extends through a second fixed portion of said center plow and further through said second biasing element;

wherein said first elongated attachment element attaches at a first rear portion of said plow wing at said center plow and engages said first biasing element at the rear of said center plow;

wherein said second elongated attachment element attaches at a second rear portion of said plow wing at said center plow and engages said second biasing element at the rear of said center plow;

wherein said first and second biasing elements allow for movement of said first and second elongated attachment elements, respectively, at the rear of said center plow to allow for pivotal movement of said plow wing relative to said center plow;

wherein outward movement of said first elongated attachment element compresses said first biasing element at said first fixed portion of said center plow, and wherein outward movement of said second elongated attachment element compresses said second biasing element at said second fixed portion of said center plow;

wherein said first and second biasing elements limit pivotal movement of said plow wing and bias said plow wing towards a neutral state, where said plow wing is normal to said center plow;

wherein said first and second attachment assemblies allow for limited inward and outward pivotal movement of said plow wing relative to the neutral state of said center plow;

wherein, with said mounting structure mounted at the vehicle, said plow wing is pivoted relative to said center plow responsive to an impact of said plow wing with an object during plowing; and wherein said first elongated attachment element of said first attachment assembly is received through an arcuate slot of said plow wing, and wherein said plow wing is pivotable about a horizontal axis at or near said second attachment assembly via movement of said first elongated attachment element of said first attachment assembly along said arcuate slot.

14. The plow assembly of claim 13, comprising a plow wing mounted at each of said ends of said center plow via first and second attachment assemblies.

15. The plow assembly of claim 13, wherein said first attachment assembly is disposed forward of said second attachment assembly.

16. The plow assembly of claim 15, wherein, when said plow wing pivots inwardly relative to said center plow, said second biasing element of said second attachment assembly compresses more than said first biasing element of said first attachment assembly.

17. The plow assembly of claim 15, wherein, when said plow wing pivots outwardly relative to said center plow, said first biasing element of said first attachment assembly compresses more than said second biasing element of said second attachment assembly.

18. The plow assembly of claim 15, wherein said first attachment assembly is disposed at an upper portion of said plow wing and said second attachment assembly is disposed at a lower portion of said plow wing.

19. The plow assembly of claim 13, wherein said second elongated attachment element of said second attachment assembly is received through a circular aperture of said plow wing, and wherein the horizontal axis comprises a longitudinal axis of said second elongated attachment element of said second attachment assembly.

20. The plow assembly of claim 13, wherein said plow wing is attached at said center plow only by said first and second attachment assemblies, and wherein said first and second attachment assemblies are disposed rearward of a curved plowing surface of said center plow such that there are no attachments or struts forward of the center plow and in the path of motion of material being plowed.

* * * * *